US005335431A

United States Patent [19]

Ohnishi

[11] Patent Number: 5,335,431

[45] Date of Patent: Aug. 9, 1994

[54] PRESSING MACHINE FOR UNFOLDING SEAMED AND FOLDED MARGINS IN CLOTHING

[75] Inventor: Yasuzo Ohnishi, Higashiosaka, Japan

[73] Assignee: Naomoto Industry Co., Ltd., Osaka, Japan

[21] Appl. No.: 77,087

[22] Filed: Jun. 16, 1993

[51] Int. Cl.[5] ..... D06F 71/30; D05B 35/02

[52] U.S. Cl. ..... 38/1 B; 112/217; 223/52.6

[58] Field of Search ..... 38/27, 29, 34, 35, 1 B, 38/2, 6, 10, 31, 44, 43; 223/39, 52.5, 52.6; 112/217, 147

[56] References Cited

U.S. PATENT DOCUMENTS

| | | | |
|---|---|---|---|
| 1,799,132 | 3/1931 | Gardner | 112/217 |
| 2,253,732 | 8/1941 | Segelin et al. | 38/1 R |
| 3,824,719 | 7/1974 | Miranker | 38/77.3 |
| 3,916,546 | 11/1975 | Bullock et al. | 38/1 B |
| 4,106,822 | 4/1977 | Pugliese | 112/217 |
| 4,756,103 | 7/1988 | Cartabbia | 112/217 X |

FOREIGN PATENT DOCUMENTS

| | | | |
|---|---|---|---|
| 2513087 | 12/1975 | Fed. Rep. of Germany | 38/1 B |
| 0821601 | 4/1981 | U.S.S.R. | 38/1 B |

*Primary Examiner*—Clifford D. Crowder
*Assistant Examiner*—Ismael Izaguirre
*Attorney, Agent, or Firm*—Armstrong, Westerman, Hattori, McLeland & Naughton

[57] ABSTRACT

A pressing apparatus including an unfolding prearranger device to preliminarily open or unfold sewing margins seamed and folded in a pressing object mounted on a trestle thereof, a pad cloth which covers the sewing margins as preliminarily opened or unfolded, a pressurizing device which forces the sewing margins as preliminarily opened or unfolded against the trestle through the pad cloth, and a conveyor which moves the unfolded prearranger device and the pressurizing device in an integrated form along seams of the sewn workpiece.

5 Claims, 6 Drawing Sheets

PRESSING MACHINE FOR UNFOLDING SEAMED AND FOLDED MARGINS IN CLOTHING

BACKGROUND AND SUMMARY OF THE INVENTION

The present invention relates to a pressing machine for unfolding or opening seamed and folded margins clothing such as suit jackets, trousers or the like.

When suit jackets, trousers or the like are sewn, their sewing margins become substantially folded together after being seamed. In a conventional method, in order to unfold the folded margins in a suit jacket, for instance, the suit jacket is applied to a pressing trestle or other similar means, and is then ironed by hand to horizontally open their sewing margins which become folded and opposed as a result of seaming.

However, manual ironing is inefficient to achieve the opening of the folded margins, and it is occasionally difficult to open the folded margins if the margins, or a jacket or other clothing to which the margins belong, are greater in thickness.

It is therefore an object if the present invention to provide for a pressing machine in which sewing margins seamed and folded in a suit jacket or other clothing (hereinafter referred to as the "workpiece") can easily and automatically be unfolded or opened horizontally.

BRIEF DESCRIPTION OF THE DRAWING

The present invention will be described with reference to the accompanying drawings, in which.

DETAILED DESCRIPTION OF THE PREFERRED EMBODIMENT

A single preferred embodiment of the pressing machine according to the present invention will be described with reference to the drawings.

Figure 1:
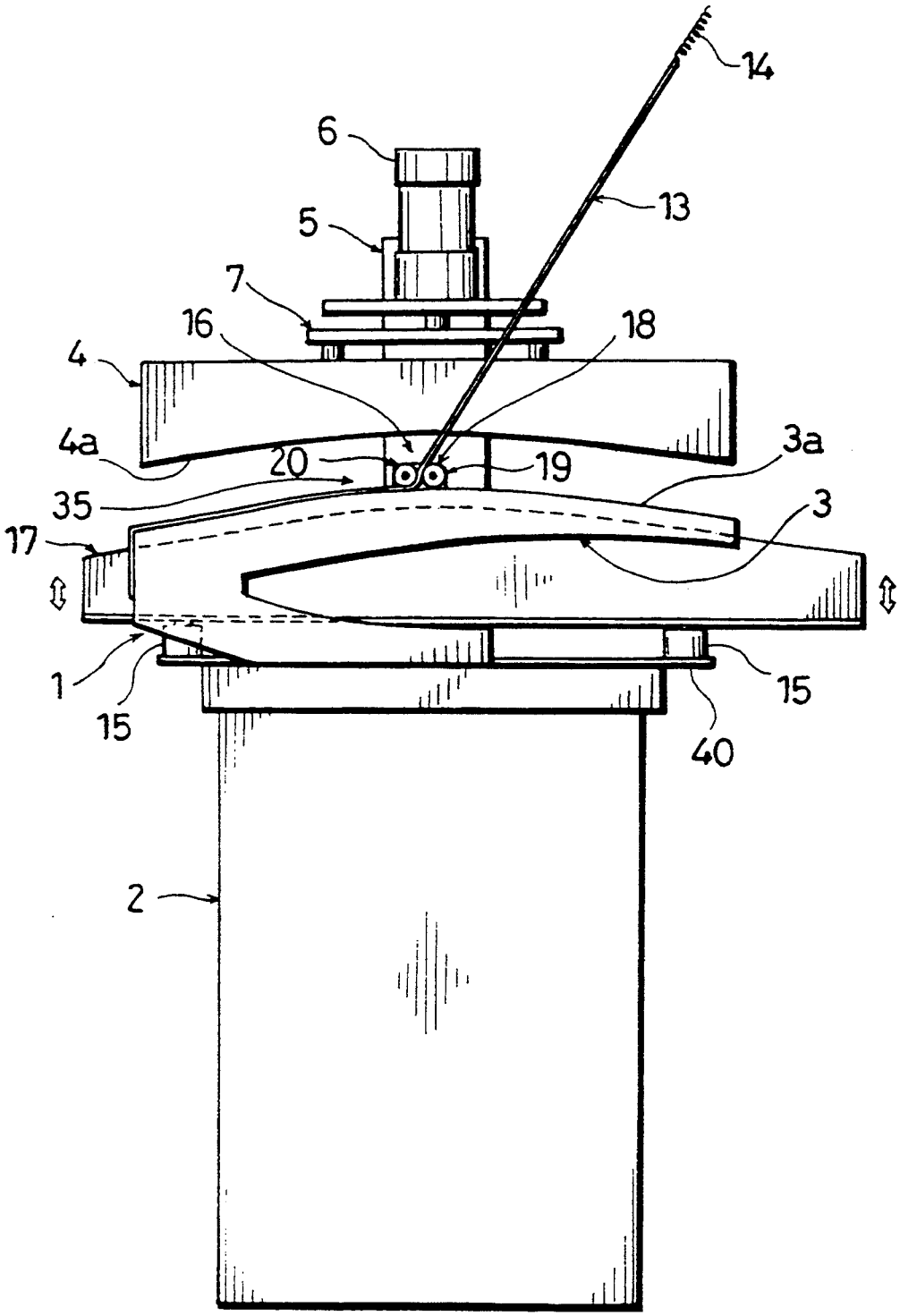
FIG. 1 is an elevational view of the pressing machine according to the present invention, which shows a preferred embodiment of the present invention.
Figure 2:
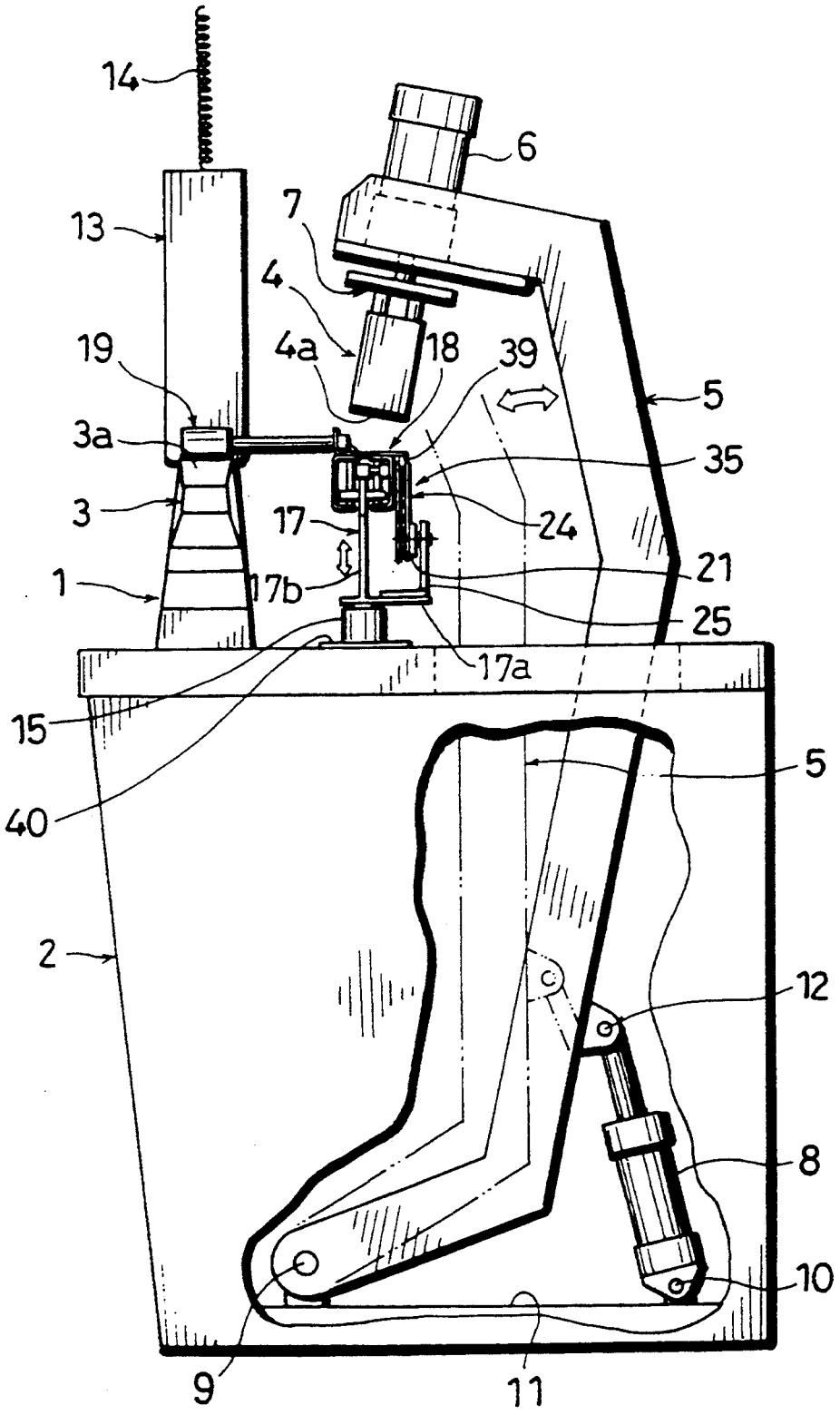
FIG. 2 is a right side view of the pressing machine shown in FIG. 1.

In a pressing machine exemplified in FIGS. 1 and 2, in which a suit jacket or trousers are mounted on a pressing trestle 1 thereof, seamed and folded margins at the back portion and sleeve portion of the jacket or those in the trousers are automatically unfolded horizontally.

The pressing trestle 1 in a substantially J-shaped configuration is provided on the upper surface of a base stand 2, and has a contact surface 3*a* on a rear portion 3 in the trestle 1 for holding workpiece, such contact surface being curved at a radius of predetermined curvature.

The pressing trestle 1 is constructed such that, for example, a hollow metal frame formed with a great number of perforations is covered with metal gauze, a silicone rubber mat, copper gauze and an urethane mat in that order in a layered configuration, and moreover, the trestle 1 is blanketed with a cloth jacket. The pressing trestle 1I thus constructed is furnished with air permeability.

Moreover, the trestle 1 is internally provided with a steam pipe and an air pipe (not shown respectively). This steam pipe is connected to a steam generator (not shown), and the air pipe is joined to an air sucking and blowing apparatus, whereby the trestle 1 is allowed to jet steam therefrom and also to blow air therefrom, while on the other hand, the trestle 1 can have air sucked thereinto.

An iron block 4 substantially in a configuration of rectangular parallelpiped is provided with a steam jetting function. This iron block 4 is shaped in a pressing surface 4*a* thereof so as to correspond configurationally with the contact surface 3*a* of the rear portion 3 that holds a workpiece.

The iron block 4 is connected through a holding means 7 to a piston rod of a pneumatic or oil-hydraulic cylinder 6 secured on the upper end portion of an arm member 5, to thereby allow the iron block 4 to move vertically in accordance with the operation of the pneumatic or oil-hydraulic cylinder 6.

Also, the lower end portion of the arm member 5 and the base end portion of an arm swinging pneumatic or oil-hydraulic cylinder 8 are respectively attached through pivots 9 and 10 to a bottom plate portion 11 within the base stand 2, while at the same time, a piston rod of the arm swinging pneumatic cylinder is connected to the arm member 5 through pivots 12. See FIG. 2.

Therefore, the operation of the arm swinging pneumatic or oil-hydraulic cylinder 8 swings the arm member 5 laterally as shown with a full line and an imaginary line in FIG. 2.

As shown in FIG. 1, a belt-shaped pad cloth 13 can cover the contact surface 3*a* of the rear portion 3 holding a workpiece, and is secured in the base end portion (the left end portion) thereof to the left end portion of the trestle 1 by means of string (not shown) or any other similar means.

Moreover, the other end portion (the right end portion) of the pad cloth 13 is engaged through a resilient member 14 such as a tension spring with a pole (not shown) or other similar member erected on the base stand 2, so that the pad cloth 13 is always tensed in the right hand side oblique upward direction in FIG. 1.

The base stand 2 is fitted with a guide rail 17 on the upper surface thereof through a mounting plate 40 and elevating mechanisms 15, 15. As shown in FIG. 2, the guide rail 17 comprises a horizontal wall portion 17*a* and a vertical wall portion 17*b* attached such as to extend vertically from the horizontal wall portion 17*a*.

The elevating mechanisms 15, 15 respectively comprise a pneumatic or oil-hydraulic cylinder (not shown). Specifically, the piston rod of this cylinder is secured on the underside of the horizontal wall portion 17*a* and the vertical motion of the piston rod causes upward or downward movement of the guide rail 17.

Also, the guide rail 17 is provided with a running body 18 which travels along the guide rail, and this running body 18 is equipped with a prearranger means 19 for unfolding, and a pressurizing means 20 for the pad cloth 13. See FIG. 4.

The vertical wall portion 17*b* of the guide rail 17 is curved at a radius of curvature which corresponds with the curvature of the contact surface 3*a* of the rear portion 3 that holds a workpiece so that the unfolding prearranger means 19 and the pressurizing means 20 can travel along the contact surface 3*a*.

The running body 18 is provided with a pair of horizontal roller means 27, 27 and three vertical roller means 28, 28, 29 which are all rotatably located within a covering case 26 thereof.

The horizontal roller means 27, 27 are brought into sliding contact with the upper end surface of the guide rail 17. The horizontal roller means 28, 28 and the other horizontal roller 29 is located such that the vertical wall portion 17*b* of the guide rail 17 are interposed therebetween, and these three roller means are brought into sliding contact with the sides of the vertical wall portion 17*b*. With such arrangement, the running body 18 travels along the guide rail 17.

Next, the unfolding prearranger means 19 comprises a first shaft 31 and a first roller means 32 rotatably held on the first shaft 31. The pressurizing means 20 for the pad cloth 13 comprises a second shaft 33 and a second roller means 34 rotatably supported on the second shaft 34.

The first roller means 32 and the second roller means 34 are located such that their outer circumferential surfaces come into proximity to each other, and the first shaft 31 and the second shaft 33 are joined in their base end portions to a vertical wall portion 26*a* of the covering case 26 of the running body 18. In this case, the vertical wall portion 26 has vertical elongated holes 45, 46 made therethrough, and these vertical elongated holes 45, 46 allow the first shaft 31 and the second shaft 33 to be adjusted in their vertical locations along them.

In order to achieve vertical positional adjustment and fixation of the first shaft 31 and the second shaft 33, the end portions of the shafts 31 and 33 are reduced in diameter as compared with their other portions, and are threaded. These end portions as threaded are inserted through the elongated holes 45 and 46. The threaded end portions of the shafts 31 and 33 which extend from the elongated holes 45 and 46 are engaged with nut means. Alternatively, the end surface portions of the shafts 31 and 33 are formed with tapped holes, and these end surface portions extending from the elongated holes 45 and 46 are mated in their tapped holes with bolt means.

With such arrangement, the pad cloth 34 is passed between the first roller means 32 and the second roller means 34, which are located in parallel with each other, such that the first roller means 32 and the second roller means 34 are respectively brought into contact with the underside of the pad cloth 34 and with the upper surface of the pad cloth 34.

Figure 3:
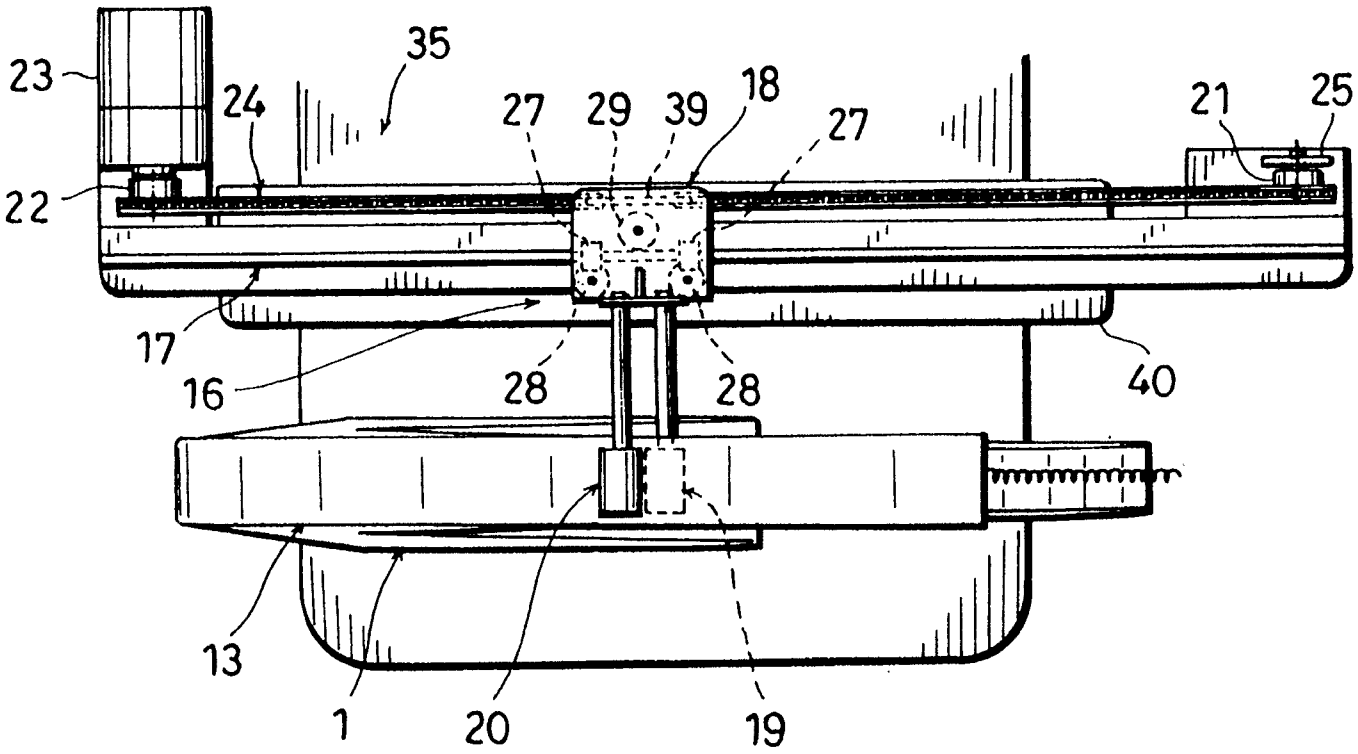
FIG. 3 is a plan view to the pressing machine shown in FIG. 1, in which some portions thereof are omitted.

Also, the running body 18 has a chain or other driving belt means 24 connected thereto, as shown in FIG. 3. The guide rail 17 is fitted with a bent piece 25 at one end thereof, and a gear 21 is rotatably attached to this bent piece 25. Also, the guide rail 17 is equipped with an electric motor 23 at the other end thereto, and this electric motor has a gear 22 rotatably connected to the shaft thereof. The driving belt means 24, such as a chain, is engaged with both gears 21 and 22.

As a result, if the motor 23 is driven, the belt means 24 are moved, and accordingly, the running body 18 travels.

Thus, the guide rail 17, the running body I 8, the gears 21 and 22, the electric motor 23 and the driving belt means are thus combined to construct a conveyor means 35 which moves the unfolding prearranger means 19 and the pressurizing means 20 in an integrated form.

The steam jetting operation of the trestle, the air sucking and blowing operation of the trestle, the steam jetting operation of the iron block 4, the rotating operation of the electric motor 23, and the driving operation of the pneumatic cylinders 6, 8 are controlled by using a control system (not shown) including limit switches, sensors, timers and/or the like. If this control system is allowed to memorize the operating sequence of the pneumatic or oil-hydraulic cylinders, the electric motor and the other components of the control system, the motor and the other components are automatically operated in order as memorized in the control system. It is possible to manually switch on or off the motor 23 and the other controlling equipments without using the control system.

Next, the operating procedure of the pressing machine arranged as described in the foregoing will be described.

Figure 6:
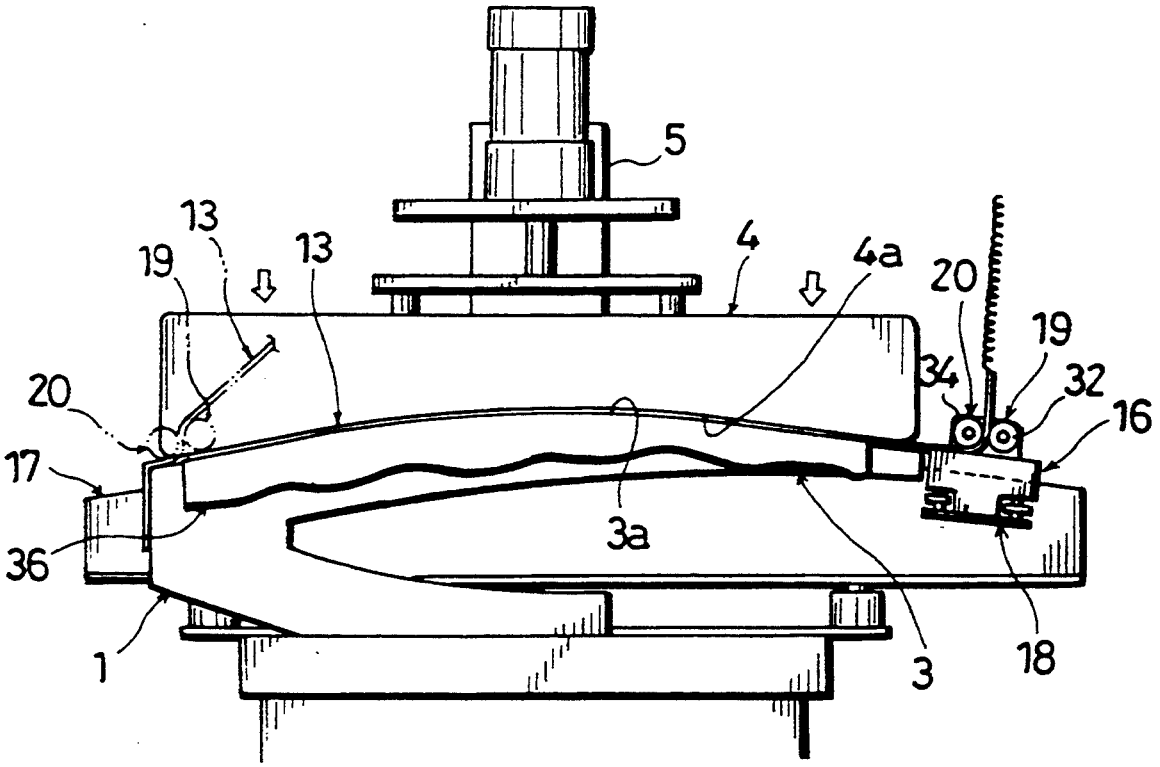
FIG. 6 is an explanatory diagram which shows that a workpiece is pressed by means of the pressing machine according to the present invention.

First of all, if the pressing machine is placed in such a state as illustrated in FIG. 1, the unfolding prearranger means 19 and the pressurizing means 20 are lifted to space them apart, and as shown with an imaginary line in FIG. 6, the running body 18 is kept in the left end portion of the guide rail 17. Also, the arm member 5 is held in a rearwards slanted condition as illustrated with a full line in FIG. 2.

Figure 4:
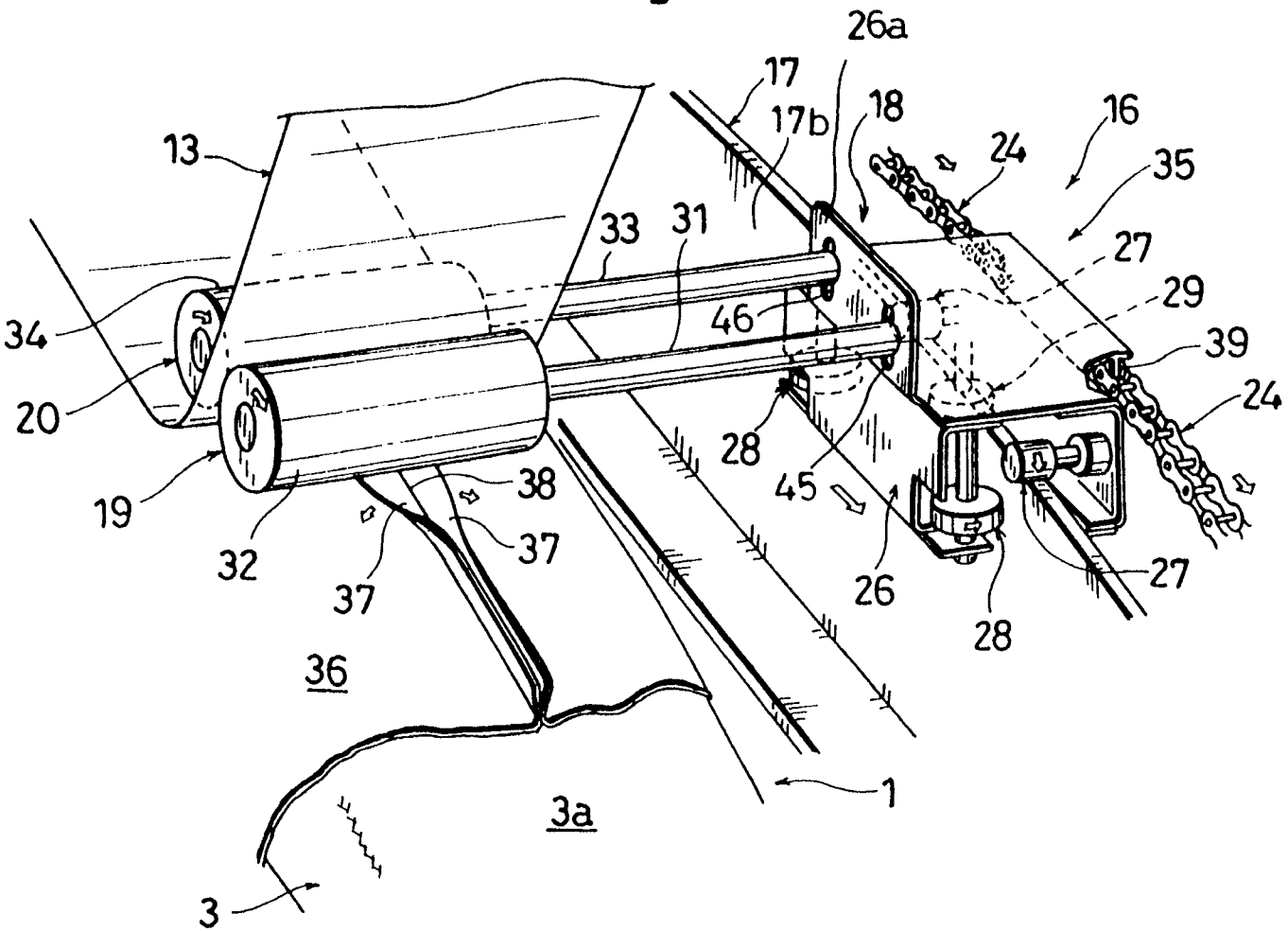
FIG. 4 is a perspective view of a principal portion of the pressing machine shown in FIG. 1, which shows an operating state thereof.
Figure 5:
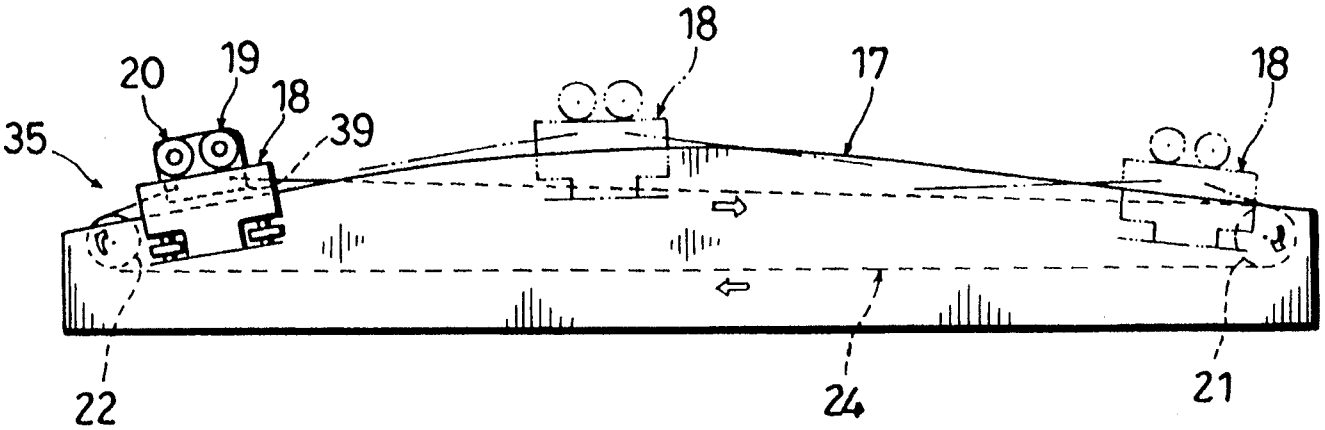
FIG. 5 is an explanatory diagram of the operation of a running body applied to the pressing machine according to the present invention.

Thereafter, as shown in FIGS. 4 and 6, the trestle 1 is provided with a workpiece 36, such as trousers, on the contact surface 3*a* of the rear portion 3 thereof. Therefore, with the workpiece 36 mounted on the trestle 1, the seamed margins 37, 37 thereof are vertically erected, and their seam 38 is brought in parallel with the contact surface 3*a* of the rear portion 3.

Moreover, the air blowing and sucking apparatus (not shown) is operated to suck the air from the trestle 1, thereby allowing the workpiece 36 to cling to the contact surface 3*a* of the rear portion 3. At this particular time, the seamed margins 37, 37 still remain folded and opposed to each other. Therefore, the seamed margins 37, 37 as folded are vertically opened by hand by small limited length (corresponding to, for example, the outside diameter of the first roller means 32) in the right hand side direction from the left end of the pressing object 36 to prearrange the substantial unfolding operation of the pressing machine.

Thereafter, the unfolding prearranger means 19 and the pressurizing means 20 are lowered onto the workpiece 36, to thereby bring the first roller means 32 of the unfolding prearranger means 19 under predetermined pressure into contact with the seamed margins 37, 37 which are horizontally pre-opened, and the second roller means 34 of the pressurizing means 20 forces the pad cloth 13 against the contact surface 3*a* of the rear portion 3.

The unfolding prearranger means 19 and the pressurizing means 20 are moved in the form of a single unit along the seams 38 of the pressing object 36. That is to say, the running body 18 is allowed to travel from the left end portion of the guide rail 17 to the right end portion thereof.

In operation, as the running body 18 travels, the first roller means 32 of the unfolding prearranger means 19 successively opens the seamed margins as opposed, so that the margins are preliminarily unfolded, while at the same time, the second roller means 34 of the pressurizing means 20 forces through the pad cloth 13 against the contact surface 3*a* of the base portion 3 of the trestle 1 the seamed margins 37, 37 which are preliminarily opened, and the pad cloth 13 covers such seamed margins successively.

In this case, the pad cloth 13 clings to the contact surface 3*a* of the base portion 3 together with the workpiece 36 as a result of the air sucking operation of the trestle 1, whereby the seamed margins 37, 37 which are pre-opened are prevented from returning to their original folded condition.

If the running body 18 reaches the right end portion of the guide rail, the arm member 5 is forwards swung as shown with an imaginary line in FIG. 2, and then, as shown in FIG. 6, the iron block 4 is lowered to force the workpiece 36 against the contact surface 3*a* through the pad cloth 13 by using the pressing surface 4*a* of the iron block 4. Also, the air sucking operation of the trestle 1 is brought to a stop.

Thus, the pad cloth 13 and the workpiece 36 are held between the pressing surface 4*a* of the iron block 4 and the contact surface 3*a* of the base portion 3, and the workpiece 6 is pressed by using steam to thereby keep the seamed margins in a completely unfolded or open condition.

After the workpiece has been steam-pressed for a predetermined period, the iron block 4 is lifted, and the arm member 5 is rearwards slanted.

Moreover, the unfolding prearranger means 19 and the pressurizing means 20 are also lifted to keep spacing between the contact surface 3*a* of the base portion 3 and a set of the unfolding prearranger means 19 and the pressurizing means 20, and the running body 18 is moved to locate it at the left end portion of the guide rail 17.

The pad cloth 13 is then removed from the upper surface of the pressing object, and the trestle is allowed to blow air therefrom to detach from the trestle the workpiece 36 in which the seamed margins are completely opened horizontally, thereby finishing the unfolding operation of the pressing machine for the seamed margins of the workpiece.

As is apparent from the foregoing description, in the pressing machine of the present invention, seamed margins as folded and opposed in the workpiece 36 can be automatically and speedily unfolded or opened if only the seamed margins are preliminarily unfolded or opened by hand by their small length. The seamed-margins unfolding or opening operation of the pressing machine according to the present invention is much superior to that of the conventional pressing machine.

Moreover, the pressing machine of the present invention is capable of unfolding or opening seamed margins of great thickness, and can be widely applied to a variety of workpiece. For this reason, the pressing machine of the present invention is extremely practical.

Although the present invention has been fully described by way of a single example with reference to the accompanying drawings, it is to be noted here that various changes and modifications will be apparent to those skilled in the art. Therefore, unless otherwise such changes and modifications depart from the scope of the present invention, they should be construed as being included therein. For example, the following modification falls under the present invention.

The roller means 32 of the unfolding prearranger means 19 and the roller means 34 of the pressurizing means 20 can be made of a material having a reduced frictional coefficient thereof and is easily slidable, both roller means can be formed in a configuration of a round bar or a spatula which is smoothed on the surface thereof.

Also, the contact surface 3*a* of the base portion 3 in the trestle 1, the upper end surface of the guide rail 17, and the pressing surface 4*a* of the iron block 4 an be horizontally formed according to the shapes of the pressing object without curving them as described in the foregoing.

I claim:

1. A pressing machine comprising a trestle, an unfolded prearranger means to preliminarily unfold sewing margins seamed and folded in a workpiece mounted on the trestle, a pad cloth which covers the sewing margins as preliminarily unfolded, a pressurizing means which operates through the pad cloth to force the sewing margins as preliminarily unfolded against the trestle, and a conveyor means which moves the unfolding prearranger means and the pressuring means in an integrated form along seams of the workpiece.

2. The pressing machine as set forth in claim 1, wherein the conveyor means is provided with a running body holding the unfolding prearranger means and the pressurizing means, a guide rail arranged substantially parallel with respect to the longitudinal direction of the trestle, a driving belt means which moves the running body along the guide rail, and an electric motor which drives the driving belt means.

3. The pressing machine as set forth in claim 1, wherein the unfolding prearranger means comprises a first shaft, and a first roller means rotatably attached to said first shaft such that said first shaft passes through said first roller means.

4. The pressing machine as set forth in claim 1, wherein the pressurizing means comprises a second shaft, and a second roller means rotatably attached to said second shaft such that said first shaft passes through said second roller means.

5. The pressing machine as set forth in claim 1, comprising elevating mechanisms which horizontally moves the unfolding prearranger means and the pressurizing means in an integrated form.

* * * * *